US006164303A

United States Patent [19]

Lin et al.

[11] Patent Number: 6,164,303

[45] Date of Patent: Dec. 26, 2000

[54] SLIM RIB ASSEMBLY FOR UMBRELLA

[75] Inventors: Chung-Kuang Lin; Jung-Jen Chang, both of Taipei Hsien, Taiwan

[73] Assignee: Fu Tai Umbrella Works, Ltd., Taipei Hsien, Taiwan

[21] Appl. No.: 09/285,701

[22] Filed: Apr. 5, 1999

[51] Int. Cl.[7] ..... A45B 19/00; A45B 25/02

[52] U.S. Cl. ..... 135/29; 135/25.3; 135/31; 135/32

[58] Field of Search ..... 135/29, 27, 31, 135/32, 25.3, 25.31, 25.32

[56] References Cited

U.S. PATENT DOCUMENTS

| | | |
|---|---|---|
| 579,403 | 3/1897 | Meyer . |
| 874,799 | 12/1907 | Schroeder . |
| 1,195,635 | 8/1916 | Altshuler et al. . |
| 1,405,824 | 2/1922 | Evans . |
| 1,559,332 | 10/1925 | Lutz et al. . |
| 4,007,752 | 2/1977 | Weber ..... 135/29 X |

*Primary Examiner*—Robert Canfield
*Attorney, Agent, or Firm*—Dougherty & Troxell

[57] ABSTRACT

A rib assembly for umbrella includes: at least a top rib pivotally secured to an upper notch fixed on a top portion of a central shaft, a stretcher rib pivotally connected with the top rib and pivotally secured to a runner slidably held on the shaft an intermediate connecting rib pivotally connected to the top rib through an intermediate connecting rib, and a tail rib pivotally connected to the intermediate rib; with the top rib formed as a slim elongate rod having an outermost end of the top rib formed as a flat thinning end portion pivotally connected with a pair of narrowing lugs centripetally pressed from two side walls of the U-shaped groove of the stretcher rib; and having an outer portion of the top rib formed as a flat thinning portion for pivotally connecting an inner end of the intermediate connecting rib, thereby forming a slim rib assembly for minimizing a folding volume of the rib assembly when closing the umbrella adapted for making a slim mini pocketable folding umbrella.

3 Claims, 4 Drawing Sheets

3
211
21
214
213
2
251
224
25
252
242
24
222
231
241
233
23
221
22
212
223
225
53
5
52
51
4
232
26
15
14
1
13
11
12
213
212
25
21
251
214
22
224
223

21
251
25
212
D 213
214
22
d
224
223

SLIM RIB ASSEMBLY FOR UMBRELLA

BACKGROUND OF THE INVENTION

A conventional rib assembly 2 as shown in FIGS. 1–5 comprises: a top rib 21 having an inner end 211 pivotally secured to an upper notch 3 fixed on a top of a central shaft 1, a stretcher rib 22 having an inner end 221 pivotally secured to a lower runner 4 slidably held on the central shaft 1 with the runner 4 engageable on a spring catch 15 resiliently retained on the shaft 1 for positioning the rib assembly of the umbrella at an opening state as shown in FIG. 1, an intermediate rib 23 having a tail rib 26 pivotally connected to an outer end of the intermediate rib 23, an intermediate connecting rib 25 having its outer end pivotally connected with the intermediate rib 23 through a joint 24 fixed on an inner end of the rib 23 and having an inner end of the intermediate connecting rib 25 pivotally connected with an outer portion of the top rib 21, and an auxiliary folding spring 5 retained between the stretcher rib 22 and the intermediate rib 23 for helping folding the ribs of the rib assembly 2 when closing the umbrella.

The central shaft 1 includes: a lower tube 11 secured with a grip 12, a middle tube 13 telescopically engageable with the lower tube 11, and an upper tube 14 telescopically engageable with the middle rib 13.

The top rib 21 of such a conventional umbrella rib assembly has an outermost end 212 pivotally connected with a pair of lugs 220 by a pivot (rivet or eyelet) 220*a*. The lug 220 as fixed on the stretcher rib 22 is protruded above a side wall of the stretcher rib 22 to occupy a volume which will influence the folding volume when closing the umbrella.

The top rib 21 is formed with a U shaped cross section, having a pivot or rivet 213*a* transversely secured on an outer portion of the top rib 21 for pivotally connecting an inner end portion 251 of the intermediate connecting rib 25. Since the pivot 213*a* has an appreciable length and the width of the top rib 21 can not be greatly minimized in consideration of the mounting of the pivot 213*a* on the rib 21, the pivot 213*a* and the top rib 21 may thus be retarded against the side walls of the stretcher rib 22, and the top rib 21 can not be completely embedded into the U shaped groove as recessed in the stretcher rib 22 (FIGS. 4, 5), thereby being impossible to greatly minimize the folding volume of the rib assembly when closing the umbrella.

Each umbrella may be consisting of six or eight sets of rib assembly 2. The total volume of the closed umbrella by folding the rib assembly 2 is therefore unable to be greatly minimized.

The present inventor has found the drawbacks of the conventional rib assembly of the umbrella, and invented the present slim rib assembly for greatly minimizing the folding volume of the umbrella rib assembly, beneficial for making a mini pocketable folding umbrella.

SUMMARY OF THE INVENTION

The object of the present invention is to provide a rib assembly for umbrella including: at least a top rib pivotally secured to an upper notch fixed on a top portion of a central shaft, a stretcher rib pivotally connected with the top rib and pivotally secured to a runner slidably held on the shaft an intermediate connecting rib pivotally connected to the top rib through an intermediate connecting rib, and a tail rib pivotally connected to the intermediate rib; with the top rib formed as a slim elongate rod having an outermost end of the top rib formed as a flat thinning end portion pivotally connected with a pair of narrowing lugs centripetally pressed from two side walls of the U-shaped groove of the stretcher rib; and having an outer portion of the top rib formed as a flat thinning portion for pivotally connecting an inner end of the intermediate connecting rib, thereby forming a slim rib assembly for minimizing a folding volume of the rib assembly when closing the umbrella adapted for making a slim mini pocketable folding umbrella.

DETAILED DESCRIPTION

Figures 1, 2, 3:
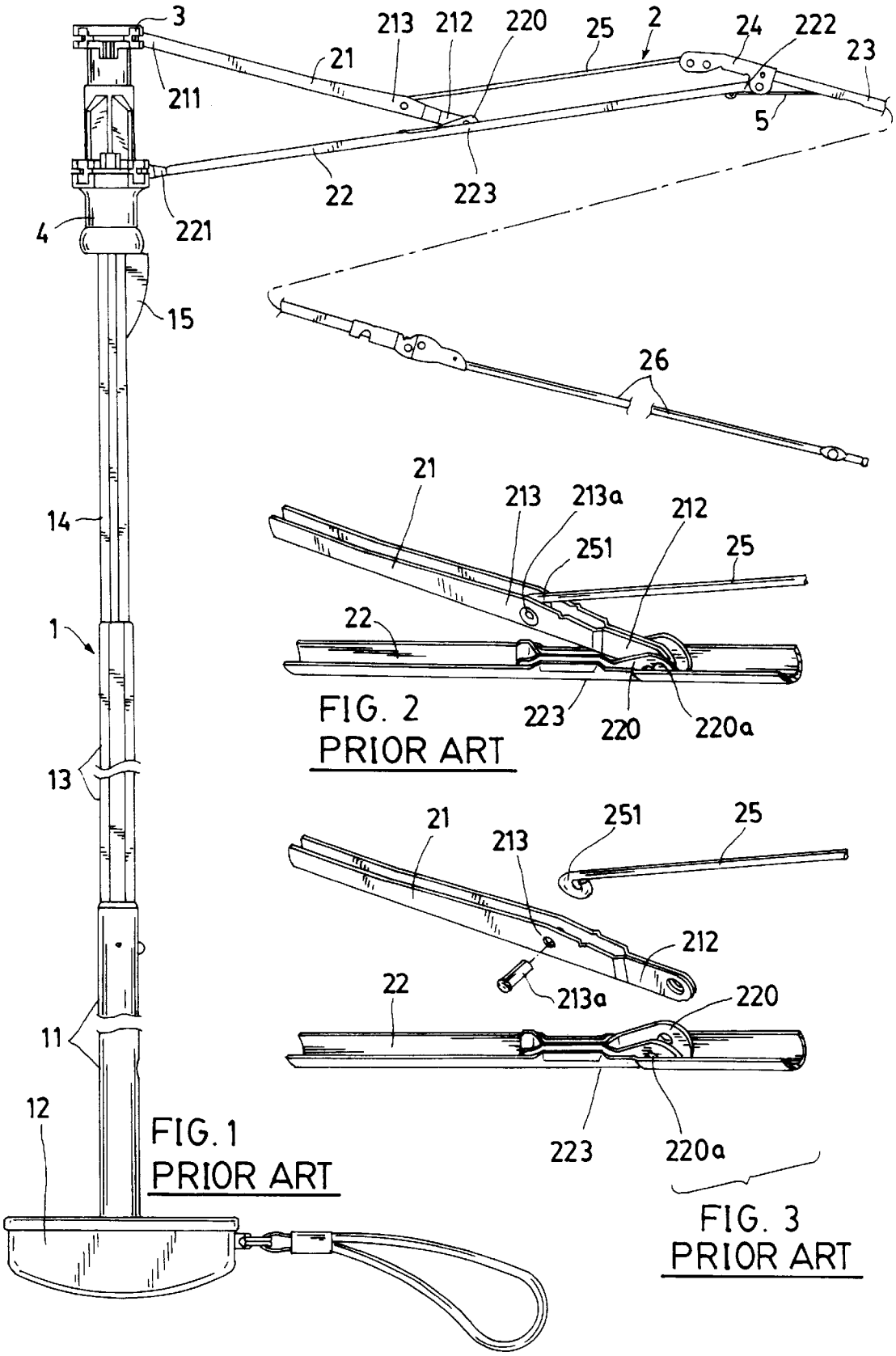
FIG. 1 PRIOR ART
FIG. 2 PRIOR ART
FIG. 3 PRIOR ART
FIG. 1 is an illustration showing an opening umbrella formed with conventional rib assembly.
FIG. 2 is a partial perspective view of the rib assembly of FIG. 1.
FIG. 3 is an exploded view of the elements as shown in FIG. 2.
Figure 4:
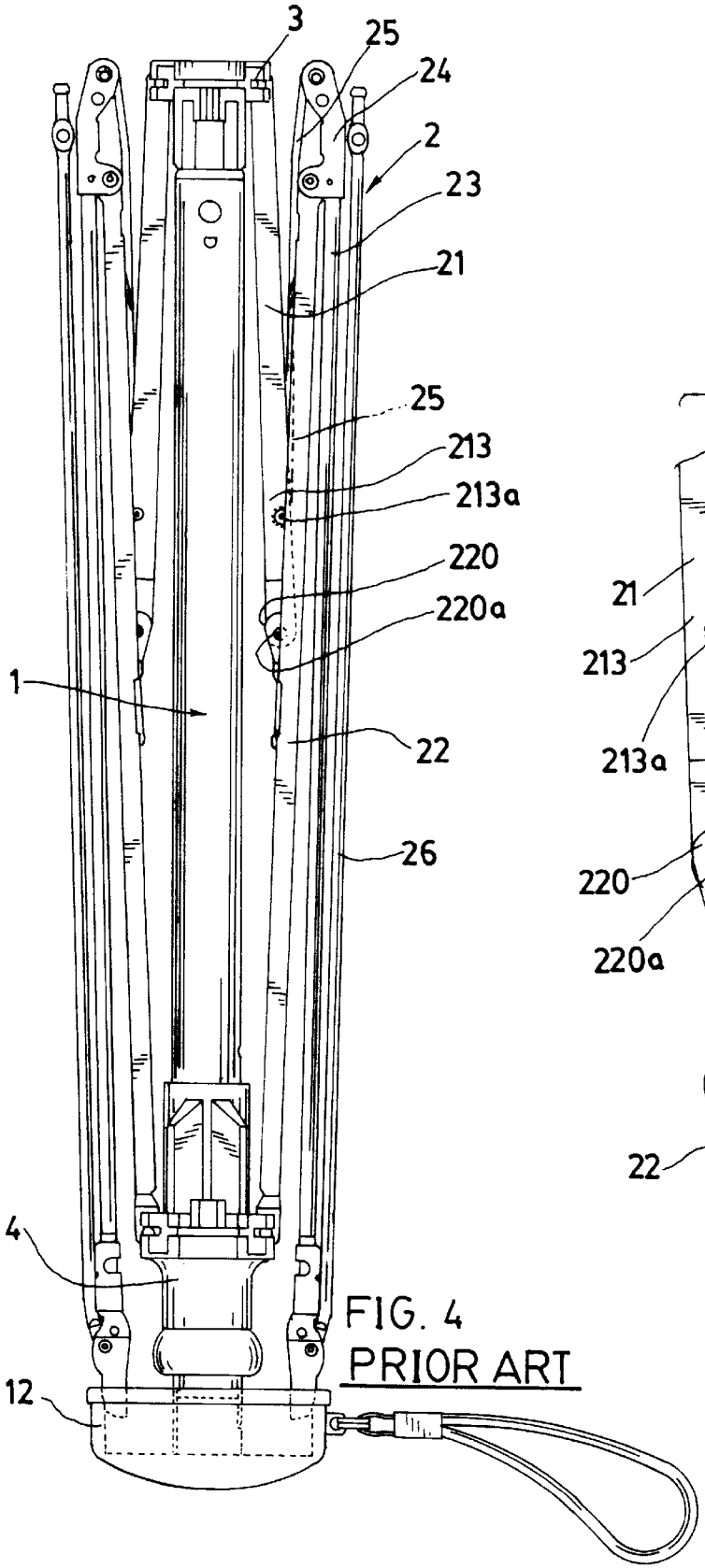
FIG. 4 PRIOR ART
FIG. 4 shows a folded umbrella when closed from FIG. 1.
Figure 5:
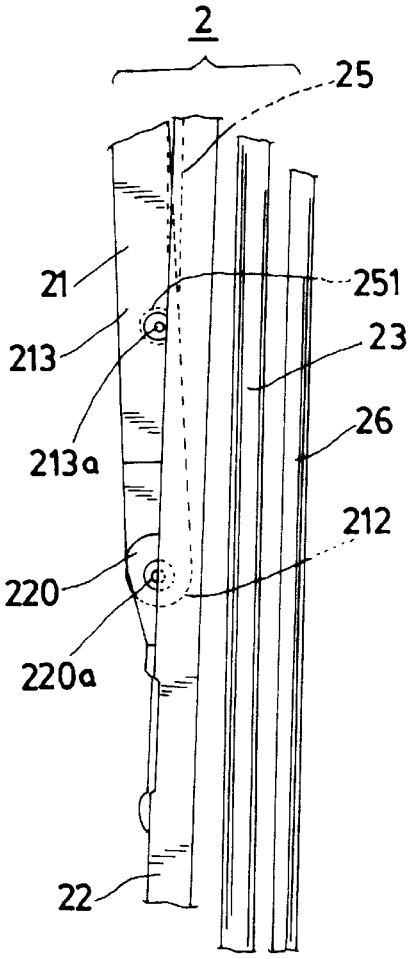
FIG. 5 PRIOR ART
FIG. 5 is a partially enlarged illustration of the folded rib assembly of FIG. 4.

As shown in FIGS. 6–10, the present invention comprises: a top rib 21 having an inner end 211 pivotally secured to an upper notch 3 fixed on a top of a central shaft 1, a stretcher rib 22 having an inner end 221 pivotally secured to a lower runner 4 slidably held on the central shaft 1, an intermediate rib 23 having an inner end 231 of the rib 23 secured with a joint 24 and having an outer end 232 of the rib 23 pivotally connected with a tail rib 26, an intermediate connecting rib 25 having an inner end 251 of the rib 25 pivotally connected with the top rib 21 and having an outer end 252 of the rib 25 pivotally connected with an inner pivot 242 of the joint 24 of which an outer pivot 241 is pivotally connected with an outermost end 222 of the stretcher rib 22, and an auxiliary folding spring 5 retained between the stretcher rib 22 and the intermediate rib 23.

Figures 6, 7, 8:
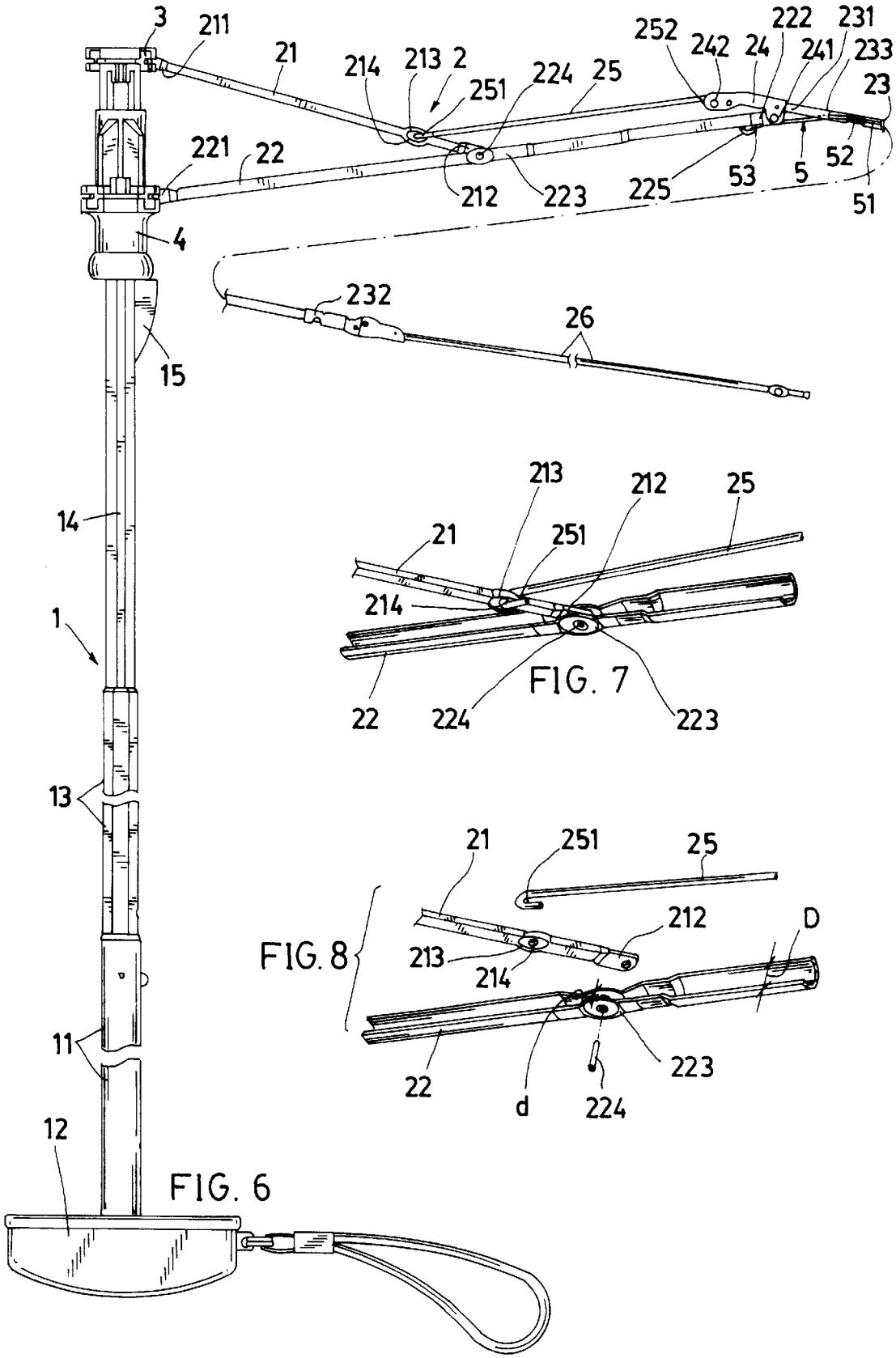
FIG. 6 is an illustration showing an opening umbrella of the present invention.
FIG. 7 is a partial perspective view of the rib assembly of the present invention.
FIG. 8 is an exploded view of the elements as shown in FIG. 7.
Figure 9:
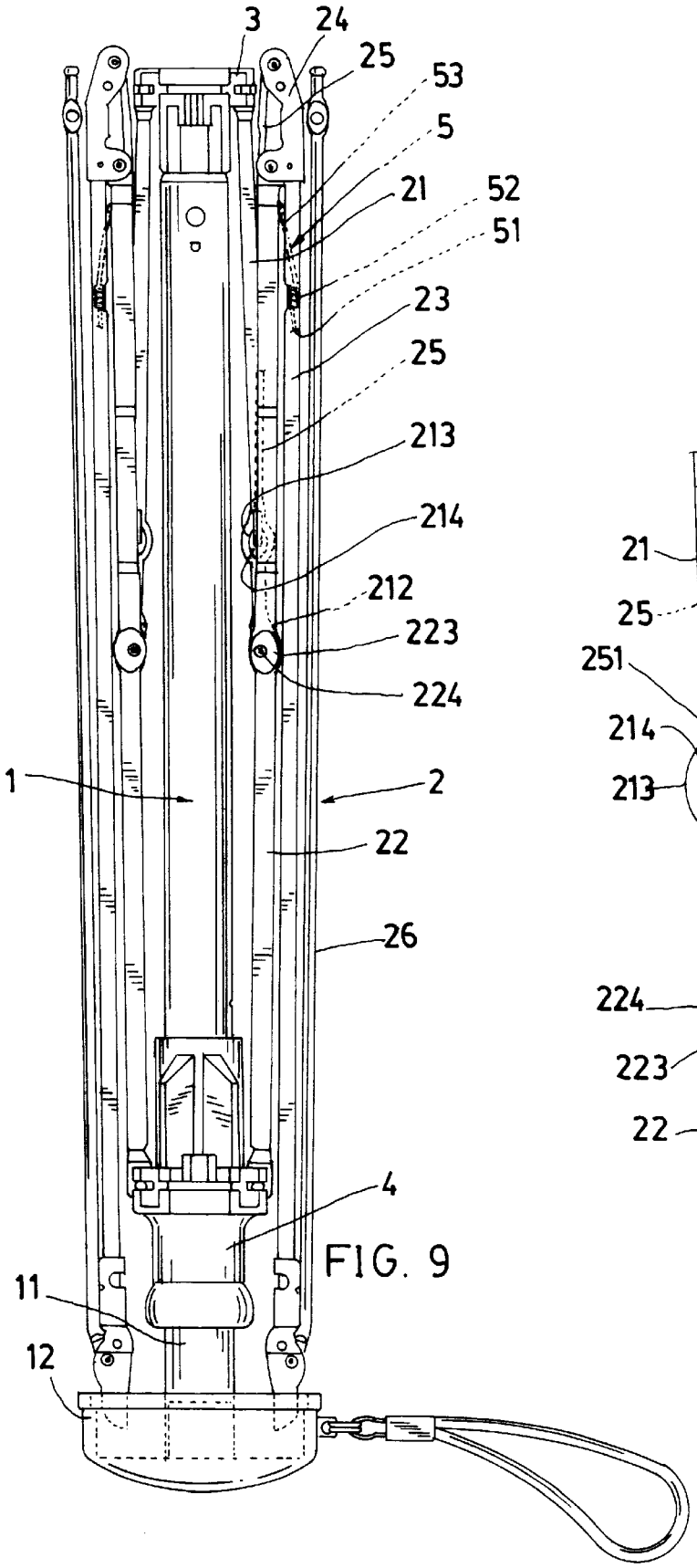
FIG. 9 shows a folded umbrella of the present invention.
Figure 10:
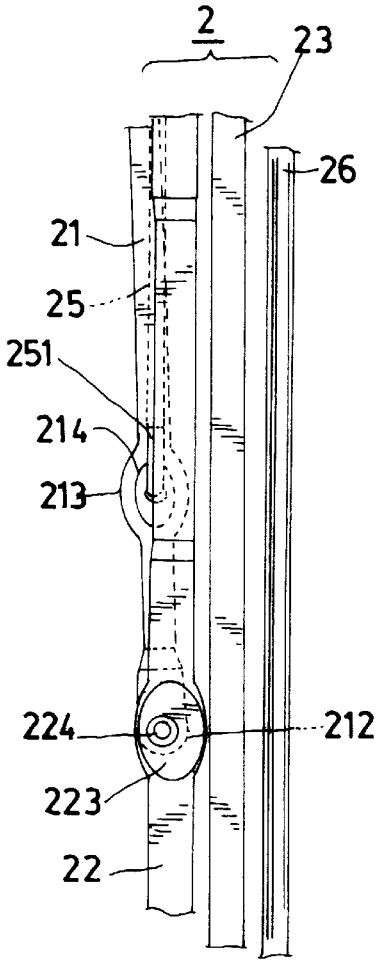
FIG. 10 shows the folded rib assembly as partially enlarged from FIG. 9.

The central shaft 1 includes: a lower tube 11 having a grip 12 secured to a lower portion of the lower tube 11, a middle tube 13 telescopically engageable with the lower tube 11, an upper tube 14 telescopically engageable with the middle tube 13, and a spring catch 15 resiliently retained on the central shaft 1 for retaining the runner 4 when opening the umbrella as shown in FIG. 6.

The auxiliary folding spring 5 includes: an outer spring end 51 slidably held in a spring coil 52 fixed in a crimped edge portion 233 formed on an inner portion of the intermediate rib 23, and an inner spring end 53 secured on an outer portion 225 of the stretcher rib 22 adjacent to the outermost end 222 of the stretcher rib 22. This auxiliary folding spring 5 will be temporarily bent, during the folding operation of the rib assembly from its opening state (FIG. 6) to the folded state (FIG. 9), to store its spring energy which will be finally released when the rib assembly is deeply folded to approach the central shaft 1, thereby facilitating the folding operation of the ribs to retract the ribs towards the shaft 1 as near as possible.

The characteristic parts of the rib assembly 2 of the present invention will be described in detail hereinafter:

The top rib 21 is formed as a slim elongate rod, having an outermost end of the top rib 21 formed as a flat thinning end portion 212 which is pivotally connected with a pair of narrowing lugs 223 formed on a middle portion of the stretcher rib and centripetally pressed from two side walls of a U shaped groove longitudinally recessed in the stretcher rib 22 (having a cross section of U shape) by a pivot 224 transversely fixed in the pair of narrowing lugs 223. The pivot 224 may be a rivet or an eyelet.

The top rib 21 has an outer portion, adjacent to the outermost end 212 of the top rib 21, directly pressed to form a flat thinning portion 213 which is formed with a pivoting hole 214 through the flat thinning portion 213 for pivotally connecting a hook end portion 251 formed on an inner end of the intermediate connecting rib 25.

Whereby upon folding of the rib assembly 2 when closing the umbrella of the present invention, the flat thinning end portion 212 and the flat thinning portion 213 of the top rib 21 as well as the inner hook end portion 251 of the intermediate connecting rib 25 will be snugly received in the U-shaped groove of the stretcher rib 22 (FIGS. 9, 10), thereby greatly minimizing the folding volume of the rib assembly 2 adapted for making a slim, miniature, compact pocketable folding umbrella.

The two narrowing lugs 223 of the stretcher rib 22 are centripetally pressed to define a narrowing distance "d" between the two lugs 223, with the narrowing distance "d" smaller than a distance "D" defined between two side walls of the U-shaped groove of the stretcher rib 22 as shown in FIG. 8.

The flat thinning portion 213 and the flat thinning end portion 212 of the top rib 21 are each flattened and pressed to have a thickness smaller than a thickness of the rod of the top rib 21.

The flat thinning portions 213, 212 on the top rib 21 and the narrowing lugs 223 on the stretcher rib 22 are flattened or pressed to be thinner to thereby greatly minimize a folding volume of the rib assembly 2 when closing the umbrella. So, the present invention provides a rib assembly especially suitable for making a slim mini compact pocketable foldable umbrella or a "flat" umbrella.

The present invention may be modified without departing from the spirit and scope of the present invention. For instance, the ribs of the rib assembly 2 may be modified to be an umbrella with quadruple or multiple folds. Also, the central shaft 1 may be modified to include plural tubes telescopically engageable with one another.

We claim:

1. A rib assembly for umbrella comprising:

a top rib (21) pivotally secured to an upper notch (3) fixed on a top of a central shaft (1), a stretcher rib (22) pivotally secured to a lower runner (4) slidably held on the central shaft (1), an intermediate rib (23) having an inner end of the intermediate rib (23) secured with a joint (24) and having an outer end of the intermediate rib (23) pivotally connected with a tail rib (26), an intermediate connecting rib (25) having an inner end thereof pivotally connected with the top rib (21) and having an outer end of the intermediate connecting rib (25) pivotally connected with the joint (24) which is also pivotally connected with an outermost end of the stretcher rib (22), and an auxiliary folding spring (5) retained between the stretcher rib (22) and the intermediate rib (23);

the improvement which comprises:

said top rib (21) formed as a slim elongate rod, having an outermost end of the top rib (21) formed as a flat thinning end portion (212) which is pivotally connected with a pair of narrowing lugs (223) formed on a middle portion of the stretcher rib and centripetally pressed from two side walls of a U shaped groove longitudinally recessed in the stretcher rib (22) by a pivot (224) transversely fixed in the pair of narrowing lugs (223);

said top rib (21) having an outer portion, adjacent to the outermost end (212) of the top rib (21), directly pressed to form a flat thinning portion (213) which is formed with a pivoting hole (214) through the flat thinning portion (213) for pivotally connecting an inner hook end portion (251) formed on an inner end of the intermediate connecting rib (25);

whereby upon folding of the rib assembly (2) when closing the umbrella, the flat thinning end portion (212) and the flat thinning portion (213) of the top rib (21) as well as the inner hook end portion (251) of the intermediate connecting rib (25) will be snugly received in the U-shaped groove of the stretcher rib (22), thereby greatly minimizing a folding volume of the rib assembly (2) adapted for making a slim pocketable folding umbrella.

2. A rib assembly according to claim 1, wherein said two narrowing lugs (223) of the stretcher rib (22) are centripetally pressed to define a narrowing distance "d" between the two lugs (223), with the narrowing distance "d" smaller than a distance "D" defined between two side walls of the U-shaped groove of the stretcher rib (22).

3. A rib assembly according to claim 1, wherein said flat thinning portion (213) and said flat thinning end portion (212) of the top rib (21) are each flattened to have a thickness smaller than a thickness of the rod of the top rib (21).

* * * * *